United States Patent [19]

DiBiase et al.

[11] Patent Number: 4,800,031

[45] Date of Patent: Jan. 24, 1989

[54] SULFUR-CONTAINING LUBRICANT AND FUNCTIONAL FLUID COMPOSITIONS

[75] Inventors: Stephen A. DiBiase; Joseph W. Pialet, both of Euclid, Ohio

[73] Assignee: The Lubrizol Corporation, Wickliffe, Ohio

[21] Appl. No.: 928,773

[22] Filed: Nov. 7, 1986

[51] Int. Cl.[4] ..... C10M 135/26; C10M 135/22

[52] U.S. Cl. ..... 252/47.5; 252/47; 252/48.2; 252/48.6; 252/49.3

[58] Field of Search ..... 252/47.5, 49.3, 47

[56] References Cited

U.S. PATENT DOCUMENTS

| | | | |
|---|---|---|---|
| 27,331 | 4/1972 | Coleman | 252/47.5 |
| 2,491,772 | 12/1949 | Rudel | 252/47.5 |
| 2,580,695 | 1/1973 | Niederhauser | 260/601 |
| 2,691,000 | 10/1954 | Elliott | 252/47.5 |
| 3,296,137 | 1/1967 | Wiese | 252/48.2 |
| 3,376,322 | 4/1968 | Thompson | 252/47.5 |
| 3,817,928 | 6/1974 | Hayashi | 260/67 S |
| 4,119,549 | 10/1978 | Davis | 252/45 |
| 4,191,659 | 3/1980 | Davis | 252/45 |
| 4,248,723 | 2/1981 | Schmidt | 252/48.6 |
| 4,659,490 | 4/1987 | Louthan et al. | 252/47.5 |

FOREIGN PATENT DOCUMENTS 2378090 1/1978 France .

OTHER PUBLICATIONS

Abstract No. 89:200224a "Nonacid Lubricating Composition", Chemical Abstracts, vol. 89, 1978, p. 153.

*Primary Examiner*—William R. Dixon, Jr.
*Assistant Examiner*—Ellen M. McAvoy
*Attorney, Agent, or Firm*—Robert A. Franks; Karl Bozicevic; Forrest L. Collins

[57] ABSTRACT

This invention is directed to lubricating and functional fluid compositions having improved antioxidant and extreme pressure properties and high temperature stability. The lubricant and functional fluid compositions comprise a major amount of at least one oil of lubricating viscosity and a minor amount of (A) a sulfur compound characterized by the structural formula

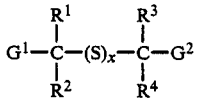

(I)

wherein $R^1$, $R^2$, $R^3$ and $R^4$ are each independently H or hydrocarbyl groups;

$R^1$ and/or $R^3$ may be $G^1$ or $G^2$;

$R^1$ and $R^2$ and/or $R^3$ and $R^4$ together may be alkylene groups containing about 4 to about 7 carbon atoms;

$G^1$ and $G^2$ are each independently C(X)R, COOR, C≡N, $R^5$—C═$NR^6$, $CON(R)_2$ or $NO_2$, and $G^1$ also ay be a $CH_2OH$ group, wherein X is O or S, $R^5$ and each R are independently H or a hydrocarbyl group, $R^6$ is H or a hydrocarbyl group;

when both $G^1$ and $G^2$ are $R^5C$═$NR^6$, the two $R^6$ groups together may be a hydrocarbylene group linking the two nitrogen atoms;

when $G^1$ is $CH_2OH$ and $G^2$ is COOR, a lactone may be formed by intramolecular combination of $G^1$ and $G^2$; and x is an integer from 1 to about 8; provided that when both $G^1$ and $G^2$ are C(O)R groups and $R^1$ and $R^3$ are H or hydrocarbyl groups, at least one R is a hydrocarbyl group.

The lubricating compositions of the present invention are particularly useful as lubricating oils, functional fluids and greases. The invention also relates to aqueous systems containing the above-described sulfur compounds represented by Formula I.

24 Claims, No Drawings

SULFUR-CONTAINING LUBRICANT AND FUNCTIONAL FLUID COMPOSITIONS

TECHNICAL FIELD OF THE INVENTION

This invention relates to lubricating oil and functional fluid compositions which have improved anti-wear and antioxidant properties. The functional fluids may be hydrocarbon-based or aqueous-based. More particularly, the invention relates to lubricating compositions which may be lubricating oils and greases useful in industrial applications and in automotive engines, transmissions and axles.

BACKGROUND OF THE INVENTION

Compositions prepared by the sulfurization of various organic materials including olefins are known in the art, and lubricants containing these compositions also are known. U.S. Pat. No. 4,191,659 describes the preparation of sulfurized olefinic compounds by the catalytic reaction of sulfur and hydrogen sulfide with olefinic compounds containing from 3 to 30 carbon atoms. The compounds are reported to be useful in lubricating compositions, particularly those prepared for use as industrial gear lubricants. U.S. Pat. No. 4,119,549 describes a similar procedure for sulfurizing olefins utilizing sulfur and hydrogen sulfide followed by removal of low boiling materials from said sulfurized mixture.

Sulfur-containing compositions characterized by the presence of at least one cycloaliphatic group with at least two nuclear carbon atoms of one cycloaliphatic group or two nuclear carbon atoms of different cycloaliphatic groups joined together through a divalent sulfur linkage are described in U.S. Pat. No. Re. 27,331. The sulfur linkage contains at least two sulfur atoms, and sulfurized Diels-Alder adducts are illustrative of the compositions disclosed in the reissue patent. The sulfur-containing compositions are useful as extreme pressure and anti-wear additives in various lubricating oils.

Dialdehydes containing disulfide groups and represented by the formula

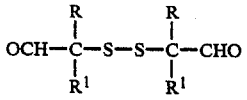

wherein both R groups are the same alkyl groups of 1 to 18 carbon atoms and both $R^1$ groups are the same alkyl or aryl groups are described in U.S. Pat. No. 2,580,695. The compounds are reported to be useful as cross-linking agents and as chemical intermediates.

Lubricating compositions containing sulfides having the formula

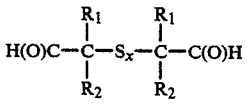

wherein $R_1$ is a hydrocarbon group, $R_2$ is hydrogen or a hydrocarbon group, and x is 1 to 2 are described in U.S. Pat. No. 3,296,137.

U.S. Pat. No. 3,817,928 describes the preparation of hydroxy-terminated polyesters of thia-bisaldehydes. The derivatives are prepared by reacting a thia-bisaldehyde with another reagent such as alcohol, organometallic compound or metal base. The derivatives are useful for industrial purposes such as in the preparation of polyurethanes. The thia-bisaldehydes which are utilized as starting materials in the U.S. Pat. No. 3,817,928 patent are similar to the thia-bisaldehydes described in the above-identified U.S. Pat. No. Re. 27,331. Hydroxy-acid derivatives of the thia-bisaldehydes are described as having the formula

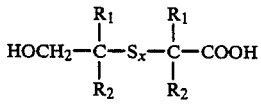

wherein $R_1$, $R_2$ and x are as defined above. The hydroxy acids can be converted to other derivatives such as lactones by intramolecular condensation in the presence of acetic anhydride or to amides by reaction with aqueous ammonia.

U.S. Pat. No. 4,248,723 describes the preparation of acetal and thioacetal derivatives of thia-bisaldehydes similar to the thia-bisaldehydes described above. The acetal and thioacetal derivatives are prepared by reacting the thia-bisaldehydes with compounds represented by the formula $R_3XH$ wherein $R_3$ is a $C_{1-18}$ alkyl, $C_{6-18}$ aryl, etc. group, and X is oxygen or sulfur. The acetal derivatives are useful as extreme pressure additives for lubricants.

SUMMARY OF THE INVENTION

This invention is directed to lubricating and functional fluid compositions having improved antioxidant and extreme pressure properties and high temperature stability. The lubricant and functional fluid compositions comprise a major amount of at least one oil of lubricating viscosity and a minor amount of (A) a sulfur compound characterized by the structural formula

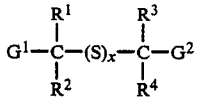

(I)

wherein $R^1$, $R^2$, $R^3$ and $R^4$ are each independently H or hydrocarbyl groups;

$R^1$ and/or $R^3$ may be $G^1$ or $G^2$;

$R^1$ and $R^2$ and/or $R^3$ and $R^4$ together may be alkylene groups containing about 4 to about 7 carbon atoms;

$G^1$ and $G^2$ are each independently C(X)R, COOR, C≡N, $R^5$—C═$NR^6$, $CON(R)_2$ or $NO_2$, and $G^1$ also may be a $CH_2OH$ group, wherein X is O or S, $R^5$ and each R are independently H or a hydrocarbyl group, $R^6$ is H or a hydrocarbyl group;

when both $G^1$ and $G^2$ are $R^5C$═$NR^6$, the two $R^6$ groups together may be a hydrocarbylene group linking the two nitrogen atoms;

when $G^1$ is $CH_2OH$ and $G_2$ is COOR, a lactone may be formed by intramolecular combination of $G^1$ and $G^2$; and x is an integer from 1 to about 8; provided that when both $G^1$ and $G^2$ are C(O)R groups and $R^1$ and $R^3$ are H or hydrocarbyl groups, at least one R is a hydrocarbyl group.

The lubricating compositions of the present invention are particularly useful as lubricating oils, functional fluids and industrial greases. The invention also relates to aqueous systems containing the above-described sulfur compounds represented by Formula I.

DESCRIPTION OF THE PREFERRED EMBODIMENTS

The lubricating and oil-based functional fluid compositions of the present invention are based on diverse oils of lubricating viscosity, including natural and synthetic lubricating oils and mixtures thereof. These lubricating compositions containing the sulfur compounds of the invention are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metal-working lubricants, hydraulic fluids, and other lubricating oil and grease compositions can benefit from the incorporation of the sulfur compounds of this invention. The lubricating compositions are particularly effective as gear lubricants.

OIL OF LUBRICATING VISCOSITY

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

(A): Sulfur Compounds

The lubricant and functional fluid compositions of the present invention comprise, in addition to the oil of lubricating viscosity, minor amounts of sulfur compounds characterized by the structural formula

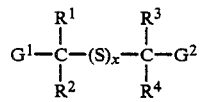

(I)

wherein $R^1$, $R^2$, $R^3$ and $R^4$ are each independently H or hydrocarbyl groups;

$R^1$ and/or $R^3$ may be $G^1$ or $G^2$;

$R^1$ and $R^2$ and/or $R^3$ and $R^4$ together may be alkylene groups containing about 4 to about 7 carbon atoms;

$G^1$ and $G^2$ are each independently C(X)R, COOR, C≡N, $R^5$—C═$NR^6$, $CON(R)_2$ or $NO_2$, and $G^1$ also may be a $CH_2OH$ group, wherein X is O or S, $R^5$ and each R are independently H or a hydrocarbyl group, $R^6$ is H or a hydrocarbyl group;

when both $G^1$ and $G^2$ are $R^5C$═$NR^6$, the two $R^6$ groups together may be a hydrocarbylene group linking the two nitrogen atoms;

when $G^1$ is $CH_2OH$ and $G^2$ is COOR, a lactone may be formed by intramolecular combination of $G^1$ and $G^2$; and x is an integer from 1 to about 8; provided that when both $G^1$ and $G^2$ are C(O)R groups and $R^1$ and $R^3$ are H or hydrocarbyl groups, at least one R is a hydrocarbyl group.

As can be seen from the above formula, the sulfur compounds utilized in the present invention are characterized by the presence of at least one thia-bisalkylene structure group of Formula II

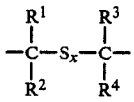

(II)

wherein $R^1$, $R^2$, $R^3$, $R^4$ and x are as described above. The two terminal valences are satisfied by the $G^1$ and $G^2$ groups specified above.

The thia-bisalkylene group which characterizes the compounds utilized in the lubricant or functional fluid compositions of the present invention is derived in many instances from thia-bisaldehydes. Although as noted from Formula I and in the appended claims, thia-bisaldehydes are not included in the sulfur compounds utilized lubricants and functional fluids in the present invention, the bisaldehydes provide, in some instances, the starting material for the sulfur compounds utilized in the present invention. Thus, in some of the embodiments of the present invention, a thia-bisaldehyde is converted to a derivative through the contemporaneous conversion of both aldehyde groups to other terminal groups by chemical reagents. In such reactions, the thia group ($S_x$) and the $R^1$, $R^2$, $R^3$ and $R^4$ groups are inert and remain unchanged in the compound.

$R^1$, $R^2$, $R^3$ and $R^4$ in Formula I are each independently hydrogen or hydrocarbyl groups. The hydrocarbyl groups may be aliphatic or aromatic groups such as alkyl, cycloalkyl, alkaryl, aralkyl or aryl groups. $R^1$ and $R^2$ and/or $R^3$ and $R^4$ together may be alkylene groups containing from about 4 to about 7 carbon atoms. In these embodiments, $R^1$ and $R^2$ together with the carbon atoms bonded to $R^1$ and $R^2$ in Formula I will form a cycloalkyl group. Similarly, $R^3$ and $R^4$ together with the carbon atom bonded to $R^3$ and $R^4$ will form a cycloalkyl group.

The hydrocarbyl groups $R^1$, $R^2$, $R^3$ and $R^4$ may be alkyl or aryl groups and usually will contain up to about 30 carbon atoms. Preferably, the hydrocarbyl groups are alkyl groups containing up to about 10 carbon atoms. Specific examples of hydrocarbyl groups include methyl, ethyl, isopropyl, isobutyl, secondary butyl, cyclohexyl, cyclopentyl, octyl, dodecyl, octadecyl, eicosyl, behenyl, triacontonyl, phenyl, naphthyl, phenethyl, octyl-phenyl, tolyl, xylyl, dioctadecyl-phenyl, triethyl-phenyl, chloro-phenyl, methoxy-phenyl, dibromo-phenyl, nitro-phenyl, 3-chlorohexyl, etc. As used in the specification and claims, the term "hydrocarbyl group" is intended to include groups which are substantially hydrocarbon in character. Thus, the hydrocarbyl groups include groups which may contain a polar substituent such as chloro, bromo, nitro, ether, etc., provided that the polar substituent is not present in proportions so as to alter significantly the hydrocarbon character of the group. In most instances, there should be no more than one polar substituent in each group.

As mentioned above, some of the sulfur compounds of the present invention as represented by Formula I are derivatives of thia-bisaldehydes. That is, $G^1$ and $G^2$ in Formula I are C(O)H groups. The various thia-bisaldehyde compounds are known, and the synthesis of such compounds have been described in the prior art such as in U.S. Pat. Nos. 3,296,137 and 2,580,695. The thia-bisaldehydes are most conveniently prepared by the sulfurization of a suitable aldehyde such as one having the structural formula $R_1R_2CHC(O)H$ wherein $R_1$ and $R_2$ are hydrogen or hydrocarbyl groups. In these instances, $R^3$ and $R^4$ in Formula I will be the same as $R^1$ and $R^2$, and both $G^1$ and $G^2$ are C(O)H groups. The sulfurization can be accomplished by reacting the aldehyde with a sulfur halide such as sulfur monochloride (i.e., $S_2Cl_2$), sulfur dichloride, sulfur monobromide, sulfur dibromide, and mixtures of sulfur halide with sulfur flowers in varying amounts.

The reaction of an aldehyde with a sulfur halide may be effected simply by mixing the two reactants at the desired temperature which may range from about −30° C. to about 250° C. or higher. The preferred reaction temperature generally is within the range of from about 10° to about 80° C. The reaction may be carried out in the presence of a diluent or solvent such as benzene, naphtha, hexane, carbon tetrachloride, chloroform, mineral oil, etc. The diluent/solvent facilitates the control of the reaction temperature and a thorough mixing of the the reactants.

The relative amounts of the aldehyde and the sulfur halide may vary over wide ranges. In most instances, the reaction involves two moles of the aldehyde and one mole of the sulfur halide. In other instances, an excess of either one of the reactants may be used. When sulfur compounds are desired which contain more than two sulfur atoms, (e.g., x is an integer from 3–8) these compounds can be obtained by reacting the aldehydes with a mixture of sulfur halide and sulfur flowers.

The thia-bisaldehydes which can be prepared as described above can be converted to derivatives containing other functional groups which are normally derivable therefrom. For example, the thia-bisaldehydes can be converted to hydroxy-acid derivatives wherein one of the aldehyde groups ($G_1$) is converted to a COOH group, and the other aldehyde group ($G_2$) is converted to a $CH_2OH$ group. The hydroxy-acid derivatives are obtainable most conveniently by treating the corresponding thia-bisaldehyde with an alkaline reagent such as an alkali metal hydroxide or alkaline earth metal hydroxide, preferably a dilute aqueous solution thereof containing from about 5 to about 50% by weight of the hydroxide in water. Such alkaline reagents may be sodium hydroxide, potassium hydroxide, lithium hydroxide, barium hydroxide, calcium hydroxide, strontium hydroxide, etc. The hydroxy-acid is isolated from the reaction mixture by acidification with a mineral acid such as hydrochloric acid. The hydroxy-acid derivatives of thia-bisaldehydes can be represented by Formula III below.

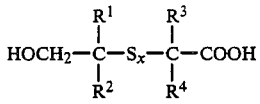

(III)

wherein $R^1$, $R^2$, $R^3$, $R^4$ and x are as previously defined. Specific examples of such hydroxy-acid derivatives include 6-hydroxy-2,2,5,5-tetramethyl-3,4-dithiahexanoic acid (i.e., conforming to Formula III wherein $R^1$, $R^2$, $R^3$ and $R^4$ are methyl and x is 2); 6-hydroxy-2,2-diethyl-5-propyl-5-butyl-3,4-dithiahexanoic acid; 6-hydroxy-2,2,5,5-tetraethyl-3,4-dithiahexanoic acid; etc.

By virtue of the presence of the hydroxy group and the carboxylic group in the hydroxy-acids described by Formula III above, various other sulfur-containing compounds useful in the present invention can be obtained by the conversion of such hydroxy group and/or the carboxylic group to other polar groups normally derivable therefrom. Examples of such derivatives include esters formed by esterification of either or both of the hydroxy group and the carboxylic group; amides, imides, and acyl halides formed through the carboxylic group; and lactones formed through intramolecular cyclization of the hydroxy-acid accompanied with the elimination of water. The procedures for preparing such derivatives are well known to those skilled in the art, and it is not believed necessary to unduly lengthen the specification by including a detailed description of such procedures. More specifically, the carboxylic group (COOH) in Formula III can be converted to ester groups (COOR) and amide groups ($CON(R)_2$) wherein the R groups may be hydrocarbyl groups containing from 1 to 30 carbon atoms and more generally from 1 to about 10 carbon atoms, and the R groups in the amide group may also be hydrogen. Specific examples of such R groups include ethyl, propyl, butyl, phenyl, etc.

The procedures for preparing lactones through intramolecular cyclization of the hydroxy-acid of Formula III accompanied by the elimination of water are well known in the art. Generally, the cyclization is promoted by the presence of materials such as acetic anhydride, and the reaction is effected by heating the mixtures to elevated temperatures such as the reflux temperature while removing volatile materials including water.

The sulfur compounds characterized by structural Formula I wherein $G^1$ and/or $G^2$ are $R^5C{=}NR^6$ also can be prepared from the corresponding thia-bisaldehydes and thia-bisketones. These mono- and di-imine compounds are prepared by reacting one mole of the dialdehyde or diketone with one or two moles of an amine, respectively. The amines may be monoamines or polyamines. When polyamines are reacted with the thia-bisaldehydes or thia-bisketones [$-C(O)R^5$], cyclic di-imines can be formed. For example, when both $G^1$ and $G^2$ in Formula I are $R^5C{=}NR^6$, the two $R^6$ groups together may be a hydrocarbylene group linking the two nitrogen atoms. The amines which are reacted with the thia-bisaldehydes to form the imines may be ammonia or primary amines characterized by the formula $R^6NH_2$ wherein $R^6$ is hydrogen, a hydrocarbyl, or an amino hydrocarbyl group. Generally, the hydrocarbyl groups will contain up to about 30 carbon atoms and will more often be aliphatic hydrocarbyl groups containing from 1 to about 10 carbon atoms.

In one preferred embodiment, the hydrocarbyl amines which are useful in preparing the imine salts of the present invention are primary hydrocarbyl amines containing from about 2 to about 30 carbon atoms in the hydrocarbyl group, and more preferably from about 4 to about 20 carbon atoms in the hydrocarbyl group. The hydrocarbyl group may be saturated or unsaturated. Representative examples of primary saturated amines are the lower alkyl amines such as methyl amine, ethyl amine, n-propyl amine, n-butyl amine, n-amyl amine, n-hexyl amine; those known as aliphatic primary fatty amines and commercially known as "Armeen" primary amines (products available from Armak Chemicals, Chicago, Ill.). Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. These Armeen primary amines are available in both distilled and technical grades. While the distilled grade will provide a purer reaction product, the desirable amides, imines and imides will form in reactions with the amines of technical grade. Also suitable are mixed fatty amines such as Armak's Armeen-C, Armeen-O, Armeen-OL, Armeen-T, Armeen-HT, Armeen S and Armeen SD.

In another preferred embodiment, the amine derived products of this invention are those derived from tertiary-aliphatic primary amines having at least about 4 carbon atoms in the alkyl group. For the most part, they are derived from alkyl amines having a total of less than about 30 carbon atoms in the alkyl group.

Usually the tertiary aliphatic primary amines are monoamines represented by the formula

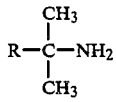

wherein R is a hydrocarbyl group containing from one to about 30 carbon atoms. Such amines are illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this invention. Illustrative of amine mixtures of this type are "Primene 81R" which is a mixture of $C_{11}$–$C_{14}$ tertiary alkyl primary amines and "Primene JM-T" which is a similar mixture of $C_{18}$–$C_{22}$ tertiary alkyl primary amines (both are available from Rohm and Haas Company). The tertiary alkyl primary amines and methods for their preparation are well known to those of ordinary skill in the art and, therefore, further discussion is unnecessary. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbon chain comprises olefinic unsaturation also are useful. Thus, the $R^6$ group may contain one or more olefinic unsaturation depending on the length of the chain, usually no more than one double bond per 10 carbon atoms. Representative amines are dodecenylamine, myristoleylamine, palmitoleylamine, oleylamine and linoleylamine. Such unsaturated amines also are available under the Armeen tradename.

The thia-bisaldehydes and thia-bisketones also can be reacted with polyamines. Examples of useful polyamines include diamines such as mono- or dialkyl, symmetrical or asymmetrical ethylene diamines, propane diamines (1,2, or 1,3), and polyamine analogs of the above. Suitable commercial fatty polyamines are "Duomeen C" (N-coco-1,3-diaminopropane), "Duomeen S" (N-soya-1,3-diaminopropane), "Duomeen T" ((N-tallow-1,3-diaminopropane), or "Duomeen O" (N-oleyl-1,3-diaminopropane). "Duomeens" are commercially available diamines described in Product Data Bulletin No. 7-10R1 of Armak Chemical Co., Chicago, Ill.

The reaction of thia-bisaldehydes (and ketones) with primary amines or polyamines can be carried out by techniques well known to those skilled in the art. Generally, the thia-bisaldehyde or ketone is reacted with the amine or polyamine by reaction in a hydrocarbon solvent at an elevated temperature, generally in an atmosphere of nitrogen. As the reaction proceeds, the water which is formed is removed such as by distillation.

Sulfur compounds characterized by structural Formula I wherein $G^1$ and $G^2$ may be C(X)R, COOR, C≡N and $NO_2$ can be prepared by the reaction of compounds characterized by the structural formula

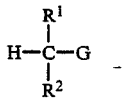

(IV)

wherein $R^1$ and $R^2$ are as defined above, and G is C(X)R, COOR, C≡N or $NO_2$, or mixtures of different compounds represented by Formula IV with a sulfur halide or a mixture of sulfur halides and sulfur flowers. Generally, about one mole of sulfur halide is reacted with two moles of the compounds represented by Formula IV. In one embodiment, $R^1$ also may G. In such instances, the sulfur compounds which are formed as a result of the reaction with the sulfur halide will contain four G groups which may be the same or different depending upon the starting material. For example, when a di-ketone such as 2,4-pentanedione is reacted with sulfur monochloride, the resulting product contains four ketone groups; when the starting material contains a ketone group and an ester group (e.g., ethylacetoacetate), the resulting product contains two ketone groups and two ester groups; and when the starting material contains two ester groups (e.g., diethylmalonate), the product contains four ester groups. Other combinations of functional groups can be introduced into the sulfur products utilized in the present invention and represented by Formula I by selecting various starting materials containing the desired functional groups.

Sulfur compounds represented by Formula I wherein $G^1$ and/or $G^2$ are C≡N groups can be prepared by the reaction of compounds represented by Formula IV wherein G is C≡N and $R^1$ and $R^2$ are hydrogen or hydrocarbyl groups. Preferably, $R^1$ is hydrogen and $R^2$ is a hydrocarbyl group. Examples of useful starting materials include, for example, propionitrile, butyronitrile, etc.

Compounds of Formula I wherein $G^1$ and $G^2$ are $NO_2$ groups can be prepared by (1) reacting a nitro hydrocarbon $R^1R^2C(H)NO_2$ with an alkali metal or alkaline earth metal alkoxide to form the salt of the nitro hydrocarbon, and (2) reacting said salt with sulfur monochloride in an inert, anhydrous nonhydroxylic medium to form a bis(1-nitrohydrocarbyl)disulfide. Preferably the nitro hydrocarbon is a primary nitro hydrocarbon ($R^1$ is hydrogen and $R^2$ is hydrocarbyl).

The starting primary nitro compounds used in carrying out this synthesis are well known. Illustrative compounds are nitroethane, 1-nitropropane, 1-nitrobutane, 1-nitro-4-methylhexane, (2-nitroethyl)benzene, etc.

The nature of the alkanol used in obtaining the alkali or alkaline earth metal salt of the starting primary nitro compound is not critical. It is only necessary that it be appropriate for reaction with the metal to form the alkoxide. Because they are easily obtainable and inexpensive, the lower alkanols (i.e., alkanols of 1 to 4 carbon atoms) such as methanol, ethanol and butanol will usually be employed in the synthesis.

The medium in which the salt is reacted with $S_2Cl_2$ must be inert to both the reactants. It is also essential that the medium be anhydrous and nonhydroxylic for the successful formation of the novel bis(1-nitrohydrocarbyl)disulfides. Examples of suitable media are ether, hexane, benzene, dioxane, higher alkyl ethers, etc.

Ordinarily, it is preferable to maintain a temperature of about 0°–10° C. during the preparation of the metal salt. However, temperatures from about 0° to 25° C. may be used in this step of the process. In the preparation of the bisdisulfide temperatures in the range of −5° to +15° C. may be used. Preferably, temperatures between about 0° to 5° C. are used in this step of the process.

Representative examples of the nitro sulfides are: bis(1-nitro-2-phenylethyl)disulfide, bis(1-nitrodecyl)disulfide, bis(1-nitrododecyl)disulfide, bis(1-nitro-2-phenyldecyl)disulfide, bis(1-nitro-2-cyclohexylethyl)disulfide, bis(1-nitropentadecyl)disulfide, bis(1-nitro-3-cyclobutylpropyl)disulfide bis(1-nitro-2-naphthylethyl)disulfide, bis(1-nitro-3-p-tolylpropyl)disulfide, bis(1-nitro-2-cyclooctylethyl)disulfide, and the like.

The carboxylic ester-containing sulfur compounds (i.e., $G^1$ is COOR) described above can be utilized to prepare other sulfur compounds useful as component (A) in the present invention. For example, the ester (COOR) can be hydrolyzed to the carboxylic acid (COOH) which can be converted to other esters by reaction with various alcohols or to amides by reaction with various amines including ammonia in primary or secondary amines such as those represented by the formula $$(R)_2NH$$

wherein each R is hydrogen or a hydrocarbyl group. These hydrocarbyl groups may contain from 1 to about 30 carbon atoms and more generally will contain from about 1 to 10 carbon atoms.

As mentioned above, $R^1$ and $R^2$ and/or $R^3$ and $R^4$ together may be alkylene groups containing from about 4 to about 7 carbon atoms. In this embodiment, $R^1$ and $R^2$ (and $R^3$ and $R^4$) form a cyclic compound with the common carbon atom. Such derivatives of structural Formula I can be prepared by reacting the appropriately substituted cyclic material with sulfur halides as described above. Examples of such cyclic starting materials include cyclohexane carboxaldehyde ($C_6H_{11}CHO$), cyclohexane carbonitrile ($C_6H_{11}CN$), cyclohexane carboxamide ($C_6H_{11}$ CHO), cyclohexane carbonitrile ($C_6H_{11}CN$), cyclohexane carboxamide ($C_6H_{11}CONH_2$), cyclohexane carboxylic acid ($C_6H_{11}COOH$), cyclobutane carboxylic acid ($C_4H_7COOH$), cycloheptane carboxylic acid ($C_7H_{13}COOH$), cycloheptyl cyanide ($C_7H_{13}CN$), etc.

The following Examples 1–3 illustrate the preparation of thia-bisaldehydes useful as intermediates in preparing some of the sulfur compositions represented by Formula I. Unless otherwise indicated in the examples and elsewhere in this specification and claims, all parts and percentages are by weight, and all temperatures are in degrees centigrade.

EXAMPLE 1

Sulfur monochloride (1620 parts, 12 moles) is charged to a 5-liter flask and warmed under nitrogen to a temperature of about 53° C. whereupon 1766 parts (24.5 moles) of isobutyraldehyde are added dropwise under nitrogen at a temperature of about 53°–60° C. over a period of about 6.5 hours. After the addition of the isobutyraldehyde is completed, the mixture is heated slowly over a period of 6 hours to a temperature of about 100° C. while blowing with nitrogen. The mixture is maintained at 100° C. with nitrogen blowing for a period of about 6 hours and volatile materials are removed from the reaction vessel. The reaction product then is filtered through a filter aid, and the filtrate is the desired product containing 31.4% sulfur (theory, 31.08%). The desired reaction product, predominantly 2,2'-dithiodiisobutyraldehyde, is recovered in about 95% yield.

EXAMPLE 2

Sulfur monochloride (405 parts, 3 moles) is charged to a 2-liter flask and warmed to about 50° C. under nitrogen whereupon 769.2 parts (6 moles) of 2-ethylhexanal are added dropwise. After about 45 minutes of addition, the reaction mixture exotherms to about 65° C. The addition of the remaining aldehyde is continued at about 55° C. over a period of about 5 hours. After allowing the mixture to stand overnight, the mixture is heated slowly to 100° C. and maintained at this temperature. Additional 2-ethylhexanal (20 parts) is added, and the mixture is maintained at 100° C. while blowing with nitrogen. The reaction mixture is stripped to 135° C./10 mm. Hg. and filtered through a filter aid. The filtrate is the desired bisaldehyde containing 19.9% sulfur (theory, 20.09).

EXAMPLE 3

Sulfur dichloride (257.5 parts, 2.5 moles) is charged to a 1-liter flask and warmed to 40° C. under nitrogen whereupon 360.5 parts (5 moles) of isobutyraldehyde are added dropwise while maintaining the reaction temperature at about 40°–45° C. The addition of the isobutyraldehyde requires about 6 hours, and the reaction initially is exothermic. The reaction mixture is maintained at room temperature overnight. After maintaining the reaction mixture at 50° C. for one hour while blowing with nitrogen, the mixture is heated to 100° C. while collecting volatile materials. An additional 72 parts of isobutyraldehyde is added, and the mixture is maintained at 100° C. for 4 hours, stripped, and filtered through filter aid. The filtrate is the desired bisaldehydes containing 24% sulfur indicating that the product is a mixture of the mono- and di-sulfide products.

The following Examples A-1 to A-15 illustrate the preparation of sulfur compounds useful as component (A) in the lubricant and functional fluids of this invention.

EXAMPLE A-1

Methanol (500 parts) is charged to a 1-liter flask, and 23 parts (1 mole) of sodium are added slowly in a nitrogen atmosphere. The mixture is cooled in an ice bath to about 5°–10° C. whereupon 89 parts (1 mole) of 1-nitropropane are added dropwise. The reaction mixture is filtered, and the solids are washed with ether. A slurry is prepared of the solids in ether, and the slurry is cooled to 0°–5° C. whereupon 67.5 parts (0.5 mole) of sulfur monochloride are added dropwise under nitrogen over a period of about 2.5 hours. An additional 200 parts of ether are added, and the mixture is filtered. The ether layer is washed with ice water and dried over magnesium sulfate. Evaporation of the ether yields the desired product containing 9.24% nitrogen and 38% sulfur.

EXAMPLE A-2

Sodium hydroxide (240 parts, 6 moles) is dissolved in water, and the solution is cooled to room temperature whereupon 824 parts (4 moles) of 2,2'-dithiodiisobutyraldehyde prepared as in Examples 1 are added over a period of about 0.75 hour. The reaction mixture exotherms to about 53° C., and after stirring for about 3 hours, the reaction mixture is extracted three times with 500 parts of toluene. The aqueous layer is cooled in an ice bath to about 7° C., and 540 parts of concentrated hydrochloric acid are added slowly at a temperature below about 10° C. A white solid forms in the reaction vessel, and the mixture is filtered. The solid is washed with ice water and dried. The solid material is the desired hydroxy-acid product containing 27.1% sulfur (theory, 28.6%).

EXAMPLE A-3

Methyl isobutyl ketone (300.6 parts, 3 moles) is charged to a 1-liter flask and heated to 60° C. whereupon 135 parts (1 mole) of sulfur monochloride are added dropwise under nitrogen over a period of about 4 hours. The reaction mixture is maintained at about 60°–70° C. during the addition, and when all of the sulfur monochloride has been added, the material is blown with nitrogen while heating to 105° C. The mixture is maintained at 105°–110° C. for several hours while collecting volatile materials. After stripping to 95° C. at reduced pressure, the reaction mixture is filtered at room temperature through a filter aid and the filtrate is the desired product containing 30.1% sulfur (theory, 24.4%).

EXAMPLE A-4

A mixture of 400 parts (4 moles) of 2,4-pentanedione and 800 parts of ethyl acetate is prepared, cooled to 10° C., and 270 parts (2 moles) of sulfur monochloride are added dropwise over a period of 4 hours at about 10°–18° C. The mixture is allowed to stand at room temperature overnight, and after cooling to about 5° C. is filtered. The solid is washed with mineral spirits and air dried. The solid material is the desired product containing 26.3% sulfur (theory, 24.4%).

EXAMPLE A-5

A mixture of 390 parts (3 moles) of ethylacetoacetate and 900 parts of ethyl acetate is prepared and cooled to 10° C. whereupon 202.5 parts (1.5 moles) of sulfur monochloride are added dropwise under nitrogen over a period of 3 hours. The temperature of the reaction reaches about 20° C. during the addition. After standing overnight at room temperature, the mixture is cooled to about 7° C. and filtered. The solids are washed with textile spirits and air dried. The solid material is the desired product containing 9.99% sulfur and having a melting point of 104°-108° C.

EXAMPLE A-6

A mixture of 650 parts (5 moles) of ethylacetoacetate and 730 parts (5 moles) of Alfol 810, a commercial mixture of alcohols containing from 8 to 10 carbon atoms, is prepared and heated to a temperature of 130° C. while collecting distillate. The temperature is slowly increased to 200° C. as ethanol is distilled. The residue is stripped to 10 mm. Hg./120° C., and the residue is the desired ester product.

A mixture of 1035 parts (4.5 moles) of the ethylacetoacetate/Alfol 810 ester product and 800 parts of ethyl acetate is prepared and cooled to 10° C. whereupon 304 parts (2.25 moles) of sulfur monochloride are added dropwise under nitrogen for a period of about 3 hours while maintaining the reaction temperature between 10°-15° C. After allowing the mixture to stand overnight at room temperature, the mixture is blown with nitrogen and heated to 110° C. while collecting solvent. After stripping to 133° C./70 mm. Hg., the mixture is filtered through a filter aid, and the filtrate is the desired product containing 11.75% sulfur (theory, 12.26%).

EXAMPLE A-7

A mixture of 480 parts (3 moles) of diethylmalonate and 800 parts of ethyl acetate is prepared and cooled to 10° C. whereupon 202.5 parts (1.5 moles) of sulfur monochloride are added dropwise under nitrogen at 10°-15° C. over a period of one hour. After allowing the mixture to stand overnight at room temperature, the mixture is heated to reflux to remove most of the solvent. The mixture then is heated to 120° C. while blowing with nitrogen, stripped to a temperature of 130° C./90 mm. Hg., and filtered through a filter aid at room temperature. The filtrate is the desired product containing 15.0% sulfur.

EXAMPLE A-8

A mixture of 480 parts (3 moles) of diethylmalonate, 876 parts (6 moles) of Alfol 810 and 3 parts of para-toluenesulfonic acid is prepared and heated to 140° C. as ethanol is distilled. The temperature is slowly increased to 180° C. while removing additional ethanol. A total of 237 parts of ethanol is collected, and 6 parts of sodium bicarbonate is added to the reaction mixture which is then stripped to 130° C. at 10 mm. Hg. The residue is filtered through a filter aid, and the filtrate is the desired ester.

A mixture of 720 parts (2 moles) of the above-prepared diethylmalonate/Alfol 810 ester product and 500 parts of ethyl acetate is prepared and cooled to about 7° C. whereupon 135 parts (1 mole) of sulfur monochloride are added dropwise under nitrogen over a period of about 2 hours while maintaining the reaction mixture at 7°-12° C. The solution is allowed to stand at room temperature overnight, warmed to reflux for 3 hours, and blown with nitrogen while heating to a temperature of about 140° C. to remove solvent. The mixture then is stripped to 140° C. at reduced pressure and filtered at room temperature. The filtrate is the desired product containing 7.51% sulfur.

EXAMPLE A-9

A mixture of 310 parts (4.2 moles) of 1,2-diaminopropane and 1200 parts of water is prepared and cooled to room temperature whereupon 412 parts (2 moles) of the bisaldehyde product prepared in Example 1 are added. The temperature of the mixture reaches 40° C. whereupon solids begin to form. The slurry is maintained at room temperature for about 4 hours and filtered. The solid is washed with water, dried and recovered. The solid is the desired product containing 10.1% nitrogen and 25.7% sulfur. The crude product melts at about 106°-112° C. and the product recrystallized from a methanol/ethanol mixture has a melting point of 114°-116° C.

EXAMPLE A-10

A mixture of 291 parts (1.3 moles) of the hydroxy monoacid prepared in Example A-2, 156 parts (2.6 moles) of normal propanol, 100 parts of toluene and 2 parts of para-toluenesulfonic acid is prepared and heated to the reflux temperature while removing water. After water elimination begins to slow down, an additional one part of the para-toluenesulfonic acid is added, and the refluxing is continued while collecting additional water. Sodium bicarbonate (5 parts) is added and the mixture is stripped at atmospheric pressure to a temperature of 110° C., and thereafter under reduced pressure to 120° C. The residue is filtered at room temperature through a filter aid, and the filtrate is the desired product containing 24.4% sulfur (theory, 24%).

EXAMPLE A-11

A mixture of 448 parts (2 moles) of the hydroxy monoacid prepared as in Example A-2, and 306 parts (3 moles) of acetic anhydride is prepared, heated to about 135° C. and maintained at this temperature for about 6 hours. The mixture is cooled to room temperature, filtered, and the filtrate is stripped at reduced pressure to 150° C. The residue is filtered while hot, and the filtrate is the desired lactone containing 29.2% sulfur (theory, 31%).

EXAMPLE A-12

A mixture of 412 parts (2 moles) of the dithiabisaldehyde prepared in Example 1 and 150 parts of toluene is prepared and heated to 80° C. where-upon 382 parts (2 moles) of Primene 81R are added dropwise while blowing with nitrogen at a temperature of 80°-90° C. A water azeotrope is removed during the addition of the Primene 81R, and after the addition is completed, the temperature is raised to 110° C. while removing additional azeotrope. The residue is stripped at reduced pressure to 105° C. and filtered at room temperature through a filter aid. The filtrate is the desired product containing 16.9% sulfur (theory, 16.88%) and 3.64% nitrogen (theory, 3.69%).

EXAMPLE A-13

The general procedure of Example A-12 is repeated except that only 206 parts of the thia-bisaldehyde of Example 1 is utilized in the reaction.

EXAMPLE A-14

The procedure of Example A-12 is repeated except that the bisaldehyde of Example 1 is replaced by an equivalent amount of the bisaldehyde of Example 2.

EXAMPLE A-15

The procedure of Example A-12 is repeated except that the bisaldehyde of Example 1 is replaced by an equivalent amount of the bisaldehyde of Example 3.

Generally, the lubricants and functional fluids of the present invention contain an amount of the sulfur compound (A) sufficient to provide the lubricants and functional fluids with the desired properties such as improved antioxidant, extreme pressure, and/or anti-wear properties. Normally, this amount will be from about 0.01 to about 20% by weight and preferably from about 0.1 to about 10% of the total weight of the lubricant or functional fluid. This amount is exclusive of solvent-/diluent medium. In lubricating compositions operated under extremely adverse conditions, such as lubricating compositions for marine diesel engines, the sulfur compounds of this invention may be present in amounts up to about 30% by weight, or more, of the total weight of the lubricating composition.

The invention also contemplates the use of other additives in the lubricating and functional fluid compositions of this invention. Such additives include, for example, detergents and dispersants of the ash-producing or ashless type, corrosion- and oxidation-inhibiting agents, pour point depressing agents, auxiliary extreme pressure and/or antiwear agents, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-betanaphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use the lubricant compositions of this invention. The following are illustrative:

(1) Reaction products of relatively high molecular weight aliphatic or alicyclic halides with amines, preferably oxyalkylene polyamines. These may be characterized as "amine dispersants" and examples thereof are described for example, in the following U.S. Pat. Nos.:

| | |
|---|---|
| 3,275,554 | 3,454,555 |
| 3,438,757 | 3,565,804 |

(2) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. Pat. Nos. are illustrative:

| | | |
|---|---|---|
| 2,459,112 | 3,442,808 | 3,591,598 |
| 2,962,442 | 3,448,047 | 3,600,372 |
| 2,984,550 | 3,454,497 | 3,634,515 |
| 3,036,003 | 3,459,661 | 3,649,229 |
| 3,166,516 | 3,461,172 | 3,697,574 |
| 3,236,770 | 3,493,520 | 3,725,277 |
| 3,355,270 | 3,539,633 | 3,725,480 |
| 3,368,972 | 3,558,743 | 3,726,882 |
| 3,413,347 | 3,586,629 | 3,980,569 |

(3) Products obtained by post-treating the amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,422 |

(4) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos.:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Auxiliary extreme pressure agents and corrosion- and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned auxiliary extreme pressure agents and corrosion-oxidation inhibitors also serve as antiwear agents. Zinc dialkylphosphorodithioates are a well known example.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, OH., 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

The following examples illustrate the lubricant and functional fluid compositions of the invention.

| | Parts by Wt. |
|---|---|
| Lubricant A | |
| Base oil | 98 |
| Product of Example A-10 | 2.00 |
| Lubricant B | |
| Base Oil | 97.75 |
| Product of Example A-12 | 2.25 |
| Lubricant C | |
| Base Oil | 97.50 |
| Product of Example A-4 | 2.50 |
| Lubricant D (ATF) | |
| Polyisobutylene (Mn 900) | 35 |
| Product of Example A-8 | 3.5 |
| Polyisobutylene succinic anhydride reacted with ethylene polyamine | 1.5 |
| Commercially available naphthenic oil having a viscosity at 40° C. of about 3.5 CKS | 29 |
| Reaction product of polyisobutenyl succinic anhydride with ethylene polyamine and carbon disulfide | 9.52 |
| Seal sweller prepared as in U.S. Pat. No. 4,029,587 | 1.67 |
| Silicone antifoam agent | 1.33 |

Lubricants E and F (Hydraulic Fluids)

| | E | F |
|---|---|---|
| 100 Neutral Mineral Oil | 88.17 | 91.11 |
| Product of Example A-4 | 1.10 | 0.85 |
| Reaction product of ethylene polyamine with polyisobutenyl succinic anhydride followed by boric acid | 0.70 | 0.50 |
| Polyisobutylene (Mn = 1400) | 6.52 | 4.89 |
| Alkylate 230 (a product of Monsanto identified as an alkylated benzene having a molecular weight of about 260) | 1.61 | 1.21 |
| Acryloid 150 (a product of Rohm & Haas identified as a methacrylate copolymer) | 0.081 | 0.060 |
| Acryloid 156 (a product of Rohm & Haas identified as a methacrylate copolymer) | 0.238 | 0.179 |
| Zinc di(2-ethylhexyl) dithiophosphate | 0.53 | 0.371 |
| Sodium petroleum sulfonate | 0.03 | 0.0506 |
| Antioxidant 732 (product of Ethyl identified as alkylated phenol) | 0.18 | 0.151 |
| Tolad 370 (product of Petrolite identified as a solution of a polyglycol in aromatic hydrocarbons) | 0.008 | 0.01 |
| Sulfurized calcium salt of dodecyl phenol | 0.07 | 0.05 |
| Tolyltriazole | 0.001 | 0.00165 |
| Acrylate terpolymer derived from 2-ethylhexyl acrylate, ethyl acrylate and vinyl acetate | — | 0.015 |
| Diluent oil | 0.76 | 0.569 |

The lubricant compositions of the present invention may be in the form of lubricating oils and greases in which any of the above-described oils of lubricating viscosity can be employed as a vehicle. Where the lubricant is to be used in the form of a grease, the lubricating oil generally is employed in an amount sufficient to balance the total grease composition and generally, the grease compositions will contain various quantities of thickening agents and other additive components to provide desirable properties. The greases will contain effective amounts of the sulfur compound (A) described above. Generally, the greases will contain from about 0.01 to about 20–30% of the sulfur compound (A).

A wide variety of thickening agents can be used in the preparation of the greases of this invention. Included among the thickening agents are alkali and alkaline earth metal soaps of fatty acids and fatty materials having from about 12 to about 30 carbon atoms. The metals are typified by sodium, lithium, calcium and barium. Examples of fatty materials include stearic acid, hydroxy stearic acid, stearin, oleic acid, palmetic acid, myristic acid, cottonseed oil acids, and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Particularly useful thickening agents employed in the grease compositions are essentially hydrophilic in character, but which have been converted into a hydrophobic condition by the introduction of long chain hydrocarbon radicals onto the surface of the clay particles prior to their use as a component of a grease composition, as, for example, by being subjected to a preliminary treatment with an organic cationic surfaceactive agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, and is believed to require no further discussion. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3% to 15% by weight of the total grease composition.

The invention also includes aqueous compositions characterized by an aqueous phase with at least one sulfur compound (A) dispersed or dissolved in said aqueous phase. Preferably, this aqueous phase is a continuous aqueous phase, although in some embodiments the aqueous phase can be a discontinuous phase. These aqueous compositions usually contain at least about 25% by weight water. Such aqueous compositions encompass both concentrates containing about 25% to about 80% by weight, preferably from about 40% to about 65% water; and water-based functional fluids containing generally over about 80% by weight of water. The concentrates generally contain from about 10% to about 90% by weight of the sulfur compound (A). The water-based functional fluids generally contain from about 0.05% to about 15% by weight of the sulfur compound (A). The concentrates generally contain less than about 50%, preferably less than about 25%, more preferably less than about 15%, and still more preferably less than about 6% hydrocarbon oil. The water-based functional fluids generally contain less than about 15%, preferably less than about 5%, and more preferably less than about 2% hydrocarbon oil.

These aqueous concentrates and water-based functional fluids can optionally include other conventional additives commonly employed in water-based functional fluids. These other additives include surfactants; thickeners; oil-soluble, water-insoluble functional additives such as anti-wear agents, extreme pressure agents, dispersants, etc.; and supplemental additives such as corrosion-inhibitors, shear stabilizing agents, bactericides, dyes, water-softeners, odor masking agents, antifoam agents and the like.

The concentrates are analogous to the water-based functional fluids except that they contain less water and proportionately more of the other ingredients. The concentrates can be converted to water-based functional fluids by dilution with water. This dilution is usually done by standard mixing techniques. This is often a convenient procedure since the concentrate can be shipped to the point of use before additional water is added. Thus, the cost of shipping a substantial amount of the water in the final water-based functional fluid is saved. Only the water necessary to formulate the concentrate (which is determined primarily by ease of handling and convenience factors), need be shipped.

Generally these water-based functional fluids are made by diluting the concentrates with water, wherein the ratio of water to concentrate is usually in the range of about 80:20 to about 99:1 by weight. As can be seen when dilution is carried out within these ranges, the final water-based functional fluid contains, at most, an insignificant amount of hydrocarbon oil.

In various preferred embodiments of the invention, the water-based functional fluids are in the form of solutions while in other embodiments they are in the form of micelle dispersions or microemulsions which appear to be true solutions. Whether a solution, micelle dispersion or microemulsion is formed is dependent, inter alia, on the particular components employed.

Also included within this invention are methods for preparing aqueous compositions, including both concentrates and water-based functional fluids, containing other conventional additives commonly employed in water-based functional fluids. These methods comprise the steps of:

(1) mixing sulfur compound (A) of the invention with such other conventional additives either simultaneously or sequentially to form a dispersion or solution; optionally (2) combining said dispersion or solution with water to form said aqueous concentrate; and/or (3) diluting said dispersion or solution, or concentrate with water wherein the total amount of water used is in the amount required to provide the desired concentration of the components of the invention and other functional additives in said concentrates or said water-based functional fluids.

These mixing steps are preferably carried out using conventional equipment and generally at room or slightly elevated temperatures, usually below 100° C. and often below 50° C. As noted above, the concentrate can be formed and then shipped to the point of use where it is diluted with water to form the desired water-based functional fluid. In other instances the finished water-based functional fluid can be formed directly in the same equipment used to form the concentrate or the dispersion or solution.

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981, North American Edition, published by McCutcheon Division, MC Publishing Co., Glen Rock, N.J., U.S.A., which is hereby incorporated by reference for its disclosures in this regard.

Among the nonionic surfactant types are the alkylene oxide-treated products, such as ethylene oxide-treated phenols, alcohols, esters, amines and amides. Ethylene oxide/propylene oxide block copolymers are also useful nonionic surfactants. Glycerol esters and sugar esters are also known to be nonionic surfactants. A typical nonionic surfactant class useful with the present invention are the alkylene oxide-treated alkyl phenols such as the ethylene oxide alkyl phenol condensates sold by the Rohm & Haas Company. A specific example of these is Triton X-100 which contains an average of 9–10 ethylene oxide units per molecule, has an HLB value of about 13.5 and a molecular weight of about 628. Many other suitable nonionic surfactants are known; see, for example, the aforementioned McCutcheon's as well as the treatise "Non-Ionic Surfactants" edited by Martin J. Schick, M. Dekker Co., New York, 1967, which is herein incorporated by reference for its disclosures in this regard.

As noted above, cationic, anionic and amphoteric surfactants can also be used. Generally, these are all hydrophilic surfactants. Anionic surfactants contain negatively charged polar groups while cationic surfactants contain positively charged polar groups. Amphoteric dispersants contain both types of polar groups in the same molecule. A general survey of useful surfactants is found in Kirk-Othmer Encyclopedia of Chemical Technology, Second Edition, Volume 19, page 507 et seq. (1969, John Wiley and Son, New York) and the aforementioned compilation published under the name of McCutcheon's. These references are both hereby incorporated by reference for their disclosures relating to cationic, amphoteric and anionic surfactants.

Among the useful anionic surfactant types are the widely known carboxylate soaps, organo sulfates, sulfonates, sulfocarboxylic acids and their salts, and phosphates. Useful cationic surfactants include nitrogen compounds such as amine oxides and the well-known quaternary ammonium salts. Amphoteric surfactants include amino acid-type materials and similar types. Various cationic, anionic and amphoteric dispersants are available from the industry, particularly from such companies as Rohm & Haas and Union Carbide Corporation, both of America. Further information about anionic and cationic surfactants also can be found in the texts "Anionic Surfactants", Parts II and III, edited by W. M. Linfield, published by Marcel Dekker, Inc., New York, 1976 and "Cationic Surfactants", edited by E. Jungermann, Marcel Dekker, Inc., New York, 1976. Both of these references are incorporated by reference for their disclosures in this regard.

These surfactants, when used, are generally employed in effective amounts to aid in the dispersal of the various additives, particularly the functional additives discussed below, in the concentrates and water-based functional fluids of the invention. Preferably, the concentrates can contain up to about 75% by weight, more preferably from about 10% to about 75% by weight of one or more of these surfactants. The water-based functional fluids can contain up to about 15% by weight, more preferably from about 0.05% to about 15% by weight of one or more of these surfactants.

Often the aqueous compositions of this invention contain at least one thickener for thickening said compositions. Generally, these thickeners can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Disclosures in this book relating to water-soluble thickening natural gums is hereby incorporated by reference. Specific examples of such gums are gum agar, guar gum, gum arabic, algin, dextrans, xanthan gum and the like. Also among the polysaccharides that are useful as thickeners for the aqueous compositions of this invention are cellulose ethers and esters, including hydroxy hydrocarbyl cellulose and hydrocarbylhydroxy cellulose and its salts. Specific examples of such thickeners are hydroxyethyl cellulose and the sodium salt of carboxymethyl cellulose. Mixtures of two or more of any such thickeners are also useful.

It is a general requirement that the thickener used in the aqueous compositions of the present invention be soluble in both cold (10° C.) and hot (about 90° C.) water. This excludes such materials as methyl cellulose which is soluble in cold water but not in hot water. Such hot-water-insoluble materials, however, can be used to perform other functions such as providing lubricity to the aqueous compositions of this invention.

These thickeners can also be synthetic thickening polymers. Many such polymers are known to those of skill in the art. Representative of them are polyacrylates, polyacrylamides, hydrolyxed vinyl esters, water-soluble homo- and interpolymers of acrylamidoalkane sulfonates containing 50 mole percent at least of acryloamido alkane sulfonate and other comonomers such as acrylonitrile, styrene and the like. Poly-n-vinyl pyrrolidones, homo- and copolymers as well as water-soluble salts of styrene, maleic anhydride and isobutylene maleic anhydride copolymers can also be used as thickening agents.

Other useful thickeners are known to those of skill in the art and many can be found in the list in the aforementioned McCutcheon Publication: "Functional Materials," 1976, pp. 135–147, inclusive. The disclosures therein, relative to water-soluble polymeric thickening agents meeting the general requirements set forth above are hereby incorporated by reference.

Preferred thickeners, particularly when the compositions of the invention are required to be stable under high shear applications, are the water-dispersible reaction products formed by reacting at least one hydrocarbyl-substituted succinic acid and/or anhydride represented by the formula

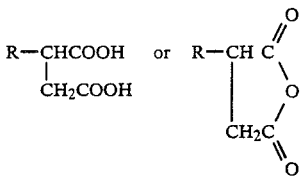

wherein R is a hydrocarbyl group of from about 8 to about 40 carbon atoms, with at least one water-dispersible amine terminated poly(oxyalkylene) or at least one water-dispersible hydroxy-terminated polyoxyalkylene. R preferably has from about 8 to about 30 carbon atoms, more preferably from about 12 to about 24 carbon atoms, still more preferably from about 16 to about 18 carbon atoms. In a preferred embodiment, R is represented by the formula

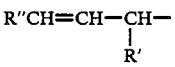

wherein R′ and R″ are independently hydrogen or straight chain or substantially straight chain hydrocarbyl groups, with the proviso that the total number of carbon atoms in R is within the above-indicated ranges. Preferably R′ and R″ are alkyl or alkenyl groups. In a particularly advantageous embodiment, R has from about 16 to about 18 carbon atoms, R′ is hydrogen or an alkyl group of from 1 to about 7 carbon atoms or an alkenyl group of from 2 to about 7 carbon atoms, and R″ is an alkyl or alkenyl group of from about 5 to about 15 carbon atoms.

The water-dispersible amine terminated poly(oxyalkylene)s are preferably alpha omega diamino poly(oxyethylene)s, alpha omega diamino poly(oxypropylene) poly(oxyethylene) poly(oxypropylene)s or alpha omega diamino propylene oxide capped poly(oxyethylene)s. The amine-terminated poly(oxyalkylene) can also be a urea condensate of such alpha omega diamino poly(oxyethylene)s, alpha omega diamino poly(oxypropylene) poly(oxyethylene) poly-(oxypropylene)s or alpha omega diamino propylene oxide capped poly(oxyethylene)s. The amine-terminated poly(oxyalkylene) can also be a polyamino (e.g., triamino, tetramino, etc.) polyoxyalkylene provided it is amine-terminated and it is water-dispersible.

Examples of water-dispersible amine-terminated poly(oxyalkylene)s that are useful in accordance with the present invention are disclosed in U.S. Pat. Nos. 3,021,232; 3,108,011; 4,444,566; and Re. 31,522. The disclosures of these patents are incorporated herein by reference. Water-dispersible amine terminated poly(oxyalkylene)s that are useful are commercially available from the Texaco Chemical Company under the trade name Jeffamine.

The water-dispersible hydroxy-terminated polyoxyalkylenes are constituted of block polymers of propylene oxide and ethylene oxide, and a nucleus which is derived from organic compounds containing a plurality of reactive hydrogen atoms. The block polymers are attached to the nucleus at the sites of the reactive hydrogen atoms. Examples of these compounds include the hydroxy-terminated polyoxyalkylenes which are represented by the formula

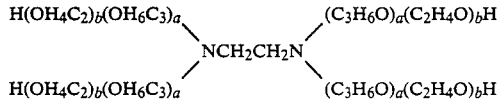

wherein a and b are integers such that the collective molecular weight of the oxypropylene chains range from about 900 to about 25,000, and the collective weight of the oxyethylene chains constitute from about 20% to about 90%, preferably from about 25% to about 55% by weight of the compound. These compounds are commercially available from BASF Wyandotte Corporation under the tradename "Tetronic". Additional examples include the hydroxy-terminated polyoxyalkylenes represented by the formula $$HO(C_2H_4O)_x(C_3H_6O)_y(C_2H_4O)_zH$$

wherein y is an integer such that the molecular weight of the oxypropylene chain is at least about 900, and x and z are integers such that the collective weight of the oxyethylene chains constitute from about 20% to about 90% by weight of the compound. These compounds preferably have a molecular weight in the range of about 1100 to about 14,000. These compounds are commercially available from BASF Wyandotte Corporation under the tradename "Pluronic". Useful hydroxy-terminated polyoxyalkylenes are disclosed in U.S. Pat. Nos. 2,674,619 and 2,979,528, which are incorporated herein by reference.

The reaction between the carboxylic agent and the amine- or hydroxy-terminated polyoxyalkylene can be carried out at a temperature ranging from the highest of the melt temperatures of the reaction components up to the lowest of the decomposition temperatures of the reaction components or products. Generally, the reaction is carried out at a temperature in the range of about 60° C. to about 160° C., preferably about 120° C. to about 160° C. The ratio of equivalents of carboxylic agent to polyoxyalkylene preferably ranges from about 0.1:1 to about 8:1, preferably about 1:1 to about 4:1, and advantageously about 2:1. The weight of an equivalent of the carboxylic agent can be determined by dividing its molecular weight by the number of carboxylic functions present. The weight of an equivalent of the amine-terminated polyoxyalkylene can be determined by dividing its molecular weight by the number of terminal amine groups present. The weight of an equivalent of the hydroxy-terminated polyoxyalkylene can be determined by dividing its molecular weight by the number of terminal terminal hydroxyl groups present. The number of terminal amine and hydroxyl groups can usually be determined from the structural formula of the polyoxyalkylene or empirically through well known procedures. The amide/acids and ester/acids formed by the reaction of the carboxylic agent and amine-terminated or hydroxy-terminated polyoxyalkylene can be neutralized with, for example, one or more alkali metals, one or more amines, or a mixture thereof, and thus converted to amide/salts or ester/salts, respectively. Additionally, if these amide/acids or ester/acids are added to concentrates or functional fluids containing alkali metals or amines, amide/salts or ester/salts usually form, in situ.

South African Pat. No. 85/0978 is incorporated herein by reference for its teachings with respect to the use of hydrocarbyl-substituted succinic acid or anhydride/hydroxy-terminated poly(oxyalkylene) reaction products as thickeners for aqueous compositions.

When the thickener is formed using an amine-terminated poly(oxyalkylene), the thickening characteristics of said thickener can be enhanced by combining it with at least one surfactant. Any of the surfactants identified above under the subtitle "Surfactants" can be used in this regard. When such surfactants are used, the weight ratio of thickener to surfactant is generally in the range of from about 1:5 to about 5:1, preferably from about 1:1 to about 3:1.

Typically, the thickener is present in a thickening amount in the aqueous compositions of this invention. When used, the thickener is preferably present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

The functional additives that can be used in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two or more of the above-mentioned ways; for example, extreme pressure agents often function as load-carrying agents.

The term "oil-soluble, water-insoluble functional additive" refers to a functional additive which is not soluble in water above a level of about 1 gram per 100 milliliters of water at 25° C., but is soluble in mineral oil to the extent of at least 1 gram per liter at 25° C.

These function additives can also include certain solid lubricants such as graphite, molybdenum disulfide and polytetrafluoroethylene and related solid polymers.

These functional additives can also include frictional polymer formers. Briefly, these are potential polymer forming materials which are dispersed in a liquid carrier at low concentration and which polymerize at rubbing or contacting surfaces to form protective polymeric films on the surfaces. The polymerizations are believed to result from the heat generated by the rubbing and, possibly, from catalytic and/or chemical action of the freshly exposed surface. A specific example of such materials is linoleic acid and ethylene glycol combinations which can form a polyester frictional polymer film. These materials are known to the art and descriptions of them are found, for example, in the journal "Wear", Volume 26, pages 369–392, and West German published patent application No. 2,339,065. These disclosures are hereby incorporated by reference for their discussions of frictional polymer formers.

Typically these functional additives are known metal or amine salts of organo sulfur, phosphorus, boron or carboxylic acids which are the same as or of the same type as used in oil-based fluids. Typically such salts are of carboxylic acids of 1 to 22 carbon atoms including both aromatic and aliphatic acids; sulfur acids such as alkyl and aromatic sulfonic acids and the like; phosphorus acids such as phosphoric acid, phosphorus acid, phosphinic acid, acid phosphate esters and analogous sulfur homologs such as the thiophosphoric and dithiophosphoric acid and related acid esters; boron acids include boric acid, acid borates and the like. Useful functional additives also include metal dithiocarbamates such as molybdenum and antimony dithiocarbamates; as well as dibutyl tin sulfide, tributyl tin oxide, phosphates and phosphites; borate amine salts, chlorinated waxes; trialkyl tin oxide, molybdenum phosphates, and chlorinated waxes.

Many such functional additives are known to the art. For example, descriptions of additives useful in conventional oil-based systems and in the aqueous systems of this invention are found in "Advances in Petroleum Chemistry and Refining", Volume 8, edited by John J. McKetta, Interscience Publishers, New York, 1963, pages 31–38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smalheer and R. K. Smith, The Lezius-Hiles Co., Cleveland, OH., U.S.A. These references are hereby incorporated by reference for their disclosures of functional additives useful in the compositions of this invention.

In certain of the typical aqueous compositions of the invention, the functional additive may be a sulfur or chloro-sulfur extreme pressure agent, known to be useful in oil-base systems. Such materials include chlorinated aliphatic hydrocarbons, such as chlorinated wax; organic sulfides and polysulfides, such as benzyldisulfide, bis-(chlorobenzyl)disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate; phosphorus esters such as the dihydrocarbon and trihydrocarbon phosphites, i.e., dibutyl phosphite, diheptyl phosphite, dicyclohexyl phosphite, pentylphenyl phosphite, dipentylphenyl phosphite, tridecyl phosphite, distearyl phosphite and polypropylene substituted phenol phosphite; metal thiocarbamates, such as zinc dioctyldithiocarbamate and barium heptylphenol dithiocarbamate; and Group II metal salts of a phosphorodithioic acid, such as zinc dicyclohexyl phosphorodithioate.

The functional additive can also be a film former such as a synthetic or natural latex or emulsion thereof in water. Such latexes include natural rubber latexes and polystyrene butadienes synthetic latex.

The functional additive can also be an anti-chatter or anti-squawk agent. Examples of the former are the amide metal dithiophosphate combinations such as disclosed in West German Pat. No. 1,109,302; amine saltazomethene combinations such as disclosed in British Patent Specification No. 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure as pertinent to anti-chatter and anti-squawk agents useful as a functional additive in the aqueous systems of the present invention.

Specific examples of functional additives useful in the aqueous systems of this invention include the following commercially available products.

TABLE I

| Functional Additive Tradename | Chemical Description | Supplier |
|---|---|---|
| Anglamol 32 | Chlorosulfurized hydrocarbon | Lubrizol[1] |
| Anglamol 75 | Zinc dialkyl phosphate | Lubrizol[1] |
| Molyvan L | A thiaphos-phomolybdate | Vanderbilt[2] |
| Lubrizol-5315 | Sulfurized cyclic carboxylate ester | Lubrizol[1] |
| Emcol TS 230 | Acid phosphate ester | Witco[3] |

[1]The Lubrizol Corporation, Wickliffe, Ohio, U.S.A.
[2]R. T. Vanderbilt Company, Inc., New York, N.Y., U.S.A.
[3]Witco Chemical Corp., Organics Division, Houston, Texas, U.S.A.

Mixtures of two or more of any of the afore-described functional additives can also be used.

Typically, a functionally effective amount of the functional additive is present in the aqueous compositions of this invention.

The term "functionally effective amount" refers to a sufficient quantity of an additive to impart desired properties intended by the addition of said additive. For example, if an additive is a rust-inhibitor, a functionally effective amount of said rust-inhibitor would be an amount sufficient to increase the rust-inhibiting characteristics of the composition to which it is added. Similarly, if the additive is an anti-wear agent, a functionally effective amount of said anti-wear agent would be a sufficient quantity of the anti-wear agent to improve the anti-wear characteristics of the composition to which it is added.

The aqueous systems of this invention often contain at least one inhibitor for corrosion of metals. These inhibitors can prevent corrosion of either ferrous or non-ferrous metals (e.g., copper, bronze, brass, titanium, aluminum and the like) or both. The inhibitor can be organic or inorganic in nature. Usually it is sufficiently soluble in water to provide a satisfactory inhibiting action though it can function as a corrosion-inhibitor without dissolveing in water, it need not be water-soluble. Many suitable inorganic inhibitors useful in the aqueous systems of the present invention are known to those skilled in the art. Included are those described in "Protective Coatings for Metals" by Burns and Bradley, Reinhold Publishing Corporation, Second Edition, Chapter 13, pages 596–605. This disclosure relative to inhibitors are hereby incorporated by reference. Specific examples of useful inorganic inhibitors include alkali metal nitrites, sodium di- and tripolyphosphate, potassium and dipotassium phosphate, alkali metal borate and mixtures of the same. Many suitable organic inhibitors are known to those of skill in the art. Specific examples include hydrocarbyl amine and hydroxy-substituted hydrocarbyl amine neutralized acid compound, such as neutralized phosphates and hydrocarbyl phosphate esters, neutralized fatty acids (e.g., those having about 8 to about 22 carbon atoms), neutralized aromatic carboxylic acids (e.g., 4-tertiarybutyl benzoic acid), neutralized naphthenic acids and neutralized hydrocarbyl sulfonates. Mixed salt esters of alkylated succinimides are also useful. Particularly useful amines include the alkanol amines such as ethanol amine, diethanolamine. Mixtures of two or more of any of the afore-described corrosion-inhibitors can also be used. The corrosion-inhibitor is usually present in concentrations in which they are effective in inhibiting corrosion of metals with which the aqueous composition comes in contact.

Certain of the aqueous systems of the present invention (particularly those that are used in cutting or shaping of metal) can also contain at least one polyol with inverse solubility in water. Such polyols are those that become less soluble as the temperature of the water increases. They thus can function as surface lubricity agents during cutting or working operations since, as the liquid is heated as a result of friction between a metal workpiece and worktool, the polyol of inverse solubility "plates out" on the surface of the workpiece, thus improving its lubricity characteristics.

The aqueous systems of the present invention can also include at least one bactericide. Such bactericides are well known to those of skill in the art and specific examples can be found in the afore-mentioned McCutcheon publication "Functional Materials" under the heading "Antimicrobials" on pages 9–20 thereof. This disclosure is hereby incorporated by reference as it relates to suitable bactericides for use in the aqueous compositions or systems of this invention. Generally, these bactericides are water-soluble, at least to the extent to allow them to function as bactericides.

The aqueous systems of the present invention can also include such other materials as dyes, e.g., an acid green dye; water softeners, e.g., ethylene diamine tetraacetate sodium salt or nitrilo triacetic acid; odor masking agents, e.g., citronella, oil of lemon, and the like; and anti-foamants, such as the well-known silicone anti-foamant agents.

The aqueous systems of this invention may also include an anti-freeze additive where it is desired to use the composition at a low temperature. Materials such as ethylene glycol and analogous polyoxyalkylene polyols can be used as anti-freeze agents. Clearly, the amount used will depend on the degree of anti-freeze protection desired and will be known to those of ordinary skill in the art.

It should also be noted that many of the ingredients described above for use in making the aqueous systems of this invention are industrial products which exhibit or confer more than one property on such aqueous compositions. Thus, a single ingredient can provide several functions thereby eliminating or reducing the need for some other additional ingredient. Thus, for example, an extreme pressure agent such as tributyl tin oxide can also function as a bactericide.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricant or functional fluid composition comprising a major amount of at least one oil of lubricating viscosity and a minor amount of:

(A) a sulfur compound characterized by the structural formula

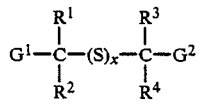

(I)

wherein $R^1$, $R^2$, $R^3$ and $R^4$ are each independently H or hydrocarbyl groups, or at least one of $R^1$ and $R^3$ is $G^1$ or $G^2$, or at least one combination of $R^1$ and $R^2$, or $R^3$ and $R^4$, together forms an alkylene group containing about 4 to about 7 carbon atoms;

$G^1$ and $G^2$ are each independently C(X)R, C≡N, $R^5$—C═$NR^6$, $CON(R)_2$ or $NO_2$, or $G^1$ is a $CH_2OH$ group, or $G^2$ is COOR, wherein X is O or S, $R^5$ and each of R are independently H or a hydrocarbyl group, $R^6$ is H or a hydrocarbyl group; or when both $G^1$ and $G^2$ are $R^5C$═$NR^6$, the two $R^6$ groups together form a hydrocarbylene group linking the two nitrogen atoms: or when $G^1$ is $CH_2OH$ and $G^2$ is COOR, a lactone is formed by intramolecular combination of $G^1$ and $G^2$; and x is an integer from 1 to about 8; provided that when both $G^1$ and $G^2$ are C(O)R groups and $R^1$ and $R^3$ are H or hydrocarbyl groups, at least one R is a hydrocarbyl group.

2. The composition of claim 1 wherein $G^1$ and $G^2$ are identical.

3. The composition of claim 1 wherein x is an integer from 1 to about 4.

4. The composition of claim 1 wherein $R^1$, $R^2$, $R^3$ and $R^4$ are hydrogen or hydrocarbyl groups, and both $G^1$ and $G^2$ are $NO_2$ groups.

5. The composition of claim 1 wherein $G^1$ and $G^2$ are C(X)R wherein R is a hydrocarbyl group.

6. The composition of claim 1 wherein $R^1$, $R^2$, $R^3$ and $R^4$ are each independently hydrogen or hydrocarbyl groups and $G^1$ and $G^2$ are $R^5$—C═$NR^6$ groups wherein $R^5$ and $R^6$ are each independently hydrogen or hydrocarbyl groups.

7. The composition of claim 1 wherein $R^2$ and $R^4$ are hydrogen or hydrocarbyl groups and $R^1$, $R^3$, $G^1$ and $G^2$ are C(O)R wherein R is a hydrocarbyl group.

8. The composition of claim 1 wherein $R^2$ and $R^4$ are hydrogen or hydrocarbyl groups, $R^1$ and $R^3$ are COOR groups, and $G^1$ and $G^2$ are C(O)R groups wherein each R is hydrogen or a hydrocarbyl group.

9. The composition of claim 8 wherein each R is independently a hydrocarbyl group.

10. The composition of claim 1 wherein $R^2$ and $R^4$ are hydrogen or hydrocarbyl groups, and $R^1$, $R^3$, $G^1$ and $G^2$ are each independently COOR groups wherein each R is a hydrocarbyl group.

11. The composition of claim 1 wherein $R^1$ and $R^3$ are hydrogen or hydrocarbyl groups, $G^1$ is $CH_2OH$, and $G^2$ is COOR wherein R is a hydrocarbyl group.

12. The composition of claim 1 containing from about 0.1 to about 20% by weight of the sulfur compound (A).

13. The composition of claim 1 wherein $R^1$, $R^2$, $R^3$ and $R^4$ are H or lower hydrocarbyl groups containing from 1 to about 7 carbon atoms.

14. A lubricant or functional fluid composition comprising a major amount of at least one oil of lubricating viscosity and a minor amount of (A) a sulfur compound characterized by the structural formula:

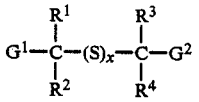

(I)

wherein $R^1$, $R^2$, $R^3$ and $R^4$ are each independently H or hydrocarbyl groups containing from 1 to about 4 carbon atoms, or at least one of $R^1$ and $R^3$ is $G^1$ or $G^2$;

$G^1$ and $G^2$ are each independently C(X)R, C≡N, $NO_2$, $CON(R)_2$ or $R^5$—C═$NR^6$, or $G^1$ is $CH_2OH$, or $G^2$ is COOR, wherein each of R and $R^5$ independently is H or a hydrocarbyl group, X is O or S, and $R^6$ is H or a hydrocarbyl group; or when both $G^1$ and $G^2$ are $R^5C$═$NR^6$, the two $R^6$ groups together form a hydrocarbylene group linking the two nitrogen atoms: or when $G^1$ is $CH_2OH$ and $G^2$ is COOR, a lactone is formed by intramolecular combination of $G^1$ and $G^2$; and x is an integer from 1 to about 8;

provided that when both $G^1$ and $G^2$ are C(O)R groups and $R^1$ and $R^3$ are H or hydrocarbyl groups, at least one R is a hydrocarbyl group.

15. The composition of claim 14 wherein $R^1$, $R^2$, $R^3$ and $R^4$ are hydrogen or hydrocarbyl groups, and both $G^1$ and $G^2$ are $R^5$—C═$NR^6$ wherein $R^5$ is hydrogen or a hydrocarbyl group and $R^6$ is a hydrocarbyl group or the two $R^6$ groups together are a hydrocarbylene group linking the two nitrogen atoms.

16. The composition of claim 15 wherein $R^5$ is hydrogen and $R^6$ is a hydrocarbyl group.

17. The composition of claim 14 wherein x is an integer from 1 to 3, or a mixture thereof.

18. The composition of claim 14 wherein $G^1$ and $G^2$ are $NO_2$, $R^1$ and $R^3$ are hydrocarbyl groups and $R^2$ and $R^4$ are hydrogen.

19. The composition of claim 14 wherein $R^2$ and $R^4$ are hydrogen or hydrocarbyl groups, and $R^1$, $R^3$, $G^1$ and $G^2$ are C(O)R groups, wherein R is a hydrocarbyl group.

20. The composition of claim 14 wherein $R^2$ and $R^4$ are hydrogen or hydrocarbyl groups, $R^1$ and $R^3$ are COOR groups, and $G^1$ and $G^2$ are C(O)R groups wherein each R is hydrogen or a hydrocarbyl group.

21. The composition of claim 1 wherein the composition is a lubricating oil or a grease.

22. The composition of claim 14 wherein the composition is a lubricating oil or a grease.

23. An aqueous system comprising at least about 40% water and at least one sulfur compound (A) characterized by the structural formula:

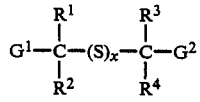

(I)

wherein $R^1$, $R^2$, $R^3$ and $R^4$ are each independently H or hydrocarbyl groups, or at least one of $R^1$ and $R^3$ is $G^1$ or $G^2$, or at least one combination of $R^1$ and $R^2$, or $R^3$ and $R^4$, together forms an alkylene group containing about 4 to about 7 carbon atoms;

$G^1$ and $G^2$ are each independently C(X)R, C≡N, $R^5$—C═$NR^6$, $CON(R)_2$ or $NO_2$, or $G^1$ is a $CH_2OH$ group, or $G^2$ is COOR, wherein X is O or S, $R^5$ and each R are independently H or a hydrocarbyl group, $R^6$ is H or a hydrocarbyl group; or when both $G^1$ and $G^2$ are $R^5C$═$NR^6$, the two $R^6$ groups together form a hydrocarbylene group linking the two nitrogen atoms: or when $G^1$ is $CH_2OH$ and $G^2$ is COOR, a lactone is formed by intramolecular combination of $G^1$ and $G^2$; and x is an integer from 1 to about 8; provided that when both $G^1$ and $G^2$ are C(O)R groups and $R^1$ and $R^3$ are H or hydrocarbyl groups, at least one R is a hydrocarbyl group.

24. An aqueous system comprising at least about 40% water and at least one sulfur compound (A) characterized by the structural formula:

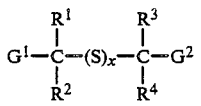

(I)

wherein $R^1$, $R^2$, $R^3$ and $R^4$ are each independently H or hydrocarbyl groups containing from 1 to about 4 carbon atoms, or at least one of $R^1$ and $R^3$ is $G^1$ or $G^2$;

$G^1$ and $G^2$ are each independently C(X)R, C═N, $C(O)N(R)_2$, $NO_2$ or $R^5$—C═$NR^6$, or $G^1$ is a $CH_2OH$, or $G^2$ is COOR, wherein each of R and $R^5$ is independently H or a hydrocarbyl group, X is O or S, and $R^6$ is H or a hydrocarbyl group;

when both $G^1$ and $G^2$ are $R^5C{=}NR^6$, the two $R^6$ groups together form a hydrocarbylene group linking the two nitrogen atoms: or when $G^1$ is $CH_2OH$ and $G^2$ is COOR, a lactone is formed by intramolecular combination of $G^1$ and $G^2$; and x is an integer from 1 to about 8; provided that when both $G^1$ and $G^2$ are C(O)R groups and $R^1$ and $R^3$ are H or hydrocarbyl groups, at least one R is hydrocarbyl group.

* * * * *

Disclaimer 4,800,031—*Stephen A. Dibiase; Joseph W. Pialet*, both of Euclid, Ohio. SULFUR-CONTAINING LUBRICANT AND FUNCTIONAL FLUID COMPOSITIONS. Patent dated Jan. 24, 1989. Disclaimer filed Aug. 28, 1991, by the assignee, The Lubrizol Corp.

The term of this patent subsequent to Jan. 24, 2006 has been disclaimed.

[*Official Gazette October 29, 1991*]